US007178591B2

(12) United States Patent
Del Campo et al.

(10) Patent No.: US 7,178,591 B2
(45) Date of Patent: Feb. 20, 2007

(54) APPARATUS AND METHOD FOR FORMATION EVALUATION

(75) Inventors: Christopher S. Del Campo, Houston, TX (US); Raymond V. Nold, III, Beasley, TX (US); Noriyuki Matsumoto, Sugar Land, TX (US); Mark Milkovisch, Cypress, TX (US); Hisayo Tauchi, Sugar Land, TX (US); Jonathan W. Brown, Sugar Land, TX (US); Ricardo Vasques, Sugar Land, TX (US); Kenneth L. Havlinek, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 345 days.

(21) Appl. No.: 10/711,187

(22) Filed: Aug. 31, 2004

(65) Prior Publication Data

US 2006/0042793 A1 Mar. 2, 2006

(51) Int. Cl.
*E21B 49/10* (2006.01)
*E21B 49/08* (2006.01)

(52) U.S. Cl. ..... 166/264; 166/100; 166/250.17; 175/50; 175/59; 73/152.17; 73/152.26

(58) Field of Classification Search ..... 166/264, 166/169, 100, 250.17, 191; 175/40, 50, 58, 175/59; 73/152.17, 152.18, 152.23, 152.24, 73/152.26, 152.28
See application file for complete search history.

(56) References Cited

U.S. PATENT DOCUMENTS 3,782,191 A 1/1974 Whitten
3,813,936 A 6/1974 Urbanosky et al.
3,859,851 A 1/1975 Urbanosky
3,864,970 A 2/1975 Bell
3,924,463 A 12/1975 Urbanosky
3,952,588 A 4/1976 Whitten
4,860,581 A 8/1989 Zimmerman et al.
4,936,139 A 6/1990 Zimmerman et al.
4,951,749 A 8/1990 Carroll (Continued)

FOREIGN PATENT DOCUMENTS

WO WO 03/098639 A1 11/2003

(Continued)

*Primary Examiner*—Kenneth Thompson
(74) *Attorney, Agent, or Firm*—Matthias Atorell; Kevin P. McEnaney; William Batzer

(57) ABSTRACT

Techniques for reduced contamination formation evaluation are provided. The techniques relate to drawing fluid into a downhole tool positionable in a wellbore penetrating a subterranean formation having a virgin fluid and a contaminated fluid therein. Fluid is drawn into at least two inlets for receiving the fluids from the formation. At least one evaluation flowline is fluidly connected to at least one of the inlets for passage of the virgin fluid into the downhole tool. At least one cleanup flowline is fluidly connected to the inlets for passage of the contaminated fluid into the downhole tool. At least one fluid circuit is fluidly connected to the evaluation flowline and/or cleanup flowlines for selectively drawing fluid therein. At least one fluid connector is provided for selectively establishing a fluid connection between the flowlines. At least one sensor is provided for measuring downhole parameters in one of the flowlines. Fluid may be selectively pumped through the flowlines to reduce the contamination in the evaluation flowline.

64 Claims, 10 Drawing Sheets

U.S. PATENT DOCUMENTS

| | | | | |
|---|---|---|---|---|
| 4,994,671 | A | 2/1991 | Safinya et al. | |
| 5,303,775 | A | 4/1994 | Michaels et al. | |
| 5,377,755 | A | 1/1995 | Michaels et al. | |
| 5,803,186 | A * | 9/1998 | Berger et al. | 175/50 |
| 6,301,959 | B1 | 10/2001 | Hrametz et al. | |
| 6,435,279 | B1 | 8/2002 | Howe et al. | |
| 6,467,544 | B1 | 10/2002 | Brown et al. | |
| 6,585,045 | B2 | 7/2003 | Lee et al. | |
| 6,609,568 | B2 | 8/2003 | Krueger et al. | |
| 6,658,930 | B2 | 12/2003 | Abbas | |
| 6,659,177 | B2 | 12/2003 | Bolze et al. | |
| 6,719,049 | B2 | 4/2004 | Sherwood et al. | |
| 6,745,835 | B2 | 6/2004 | Fields | |
| 7,090,012 | B2 * | 8/2006 | Hill et al. | 166/264 |
| 2002/0189339 | A1 | 12/2002 | Montalvo et al. | |
| 2003/0042021 | A1 | 3/2003 | Bolze et al. | |
| 2003/0145652 | A1 | 8/2003 | Arian | |
| 2004/0000433 | A1 | 1/2004 | Hill et al. | |
| 2004/0099443 | A1 | 5/2004 | Meister et al. | |
| 2006/0076132 | A1 * | 4/2006 | Nold et al. | 166/264 |
| 2006/0117842 | A1 * | 6/2006 | Ramakrishnan | 73/152.55 |

FOREIGN PATENT DOCUMENTS

| | | |
|---|---|---|
| WO | WO 04/020982 A1 | 3/2004 |

* cited by examiner

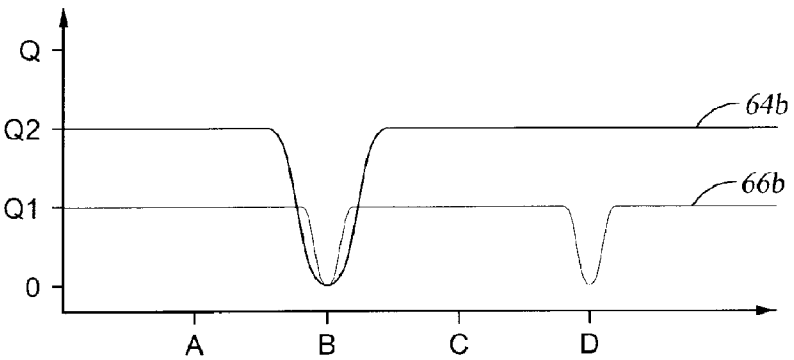
Fig. 6A
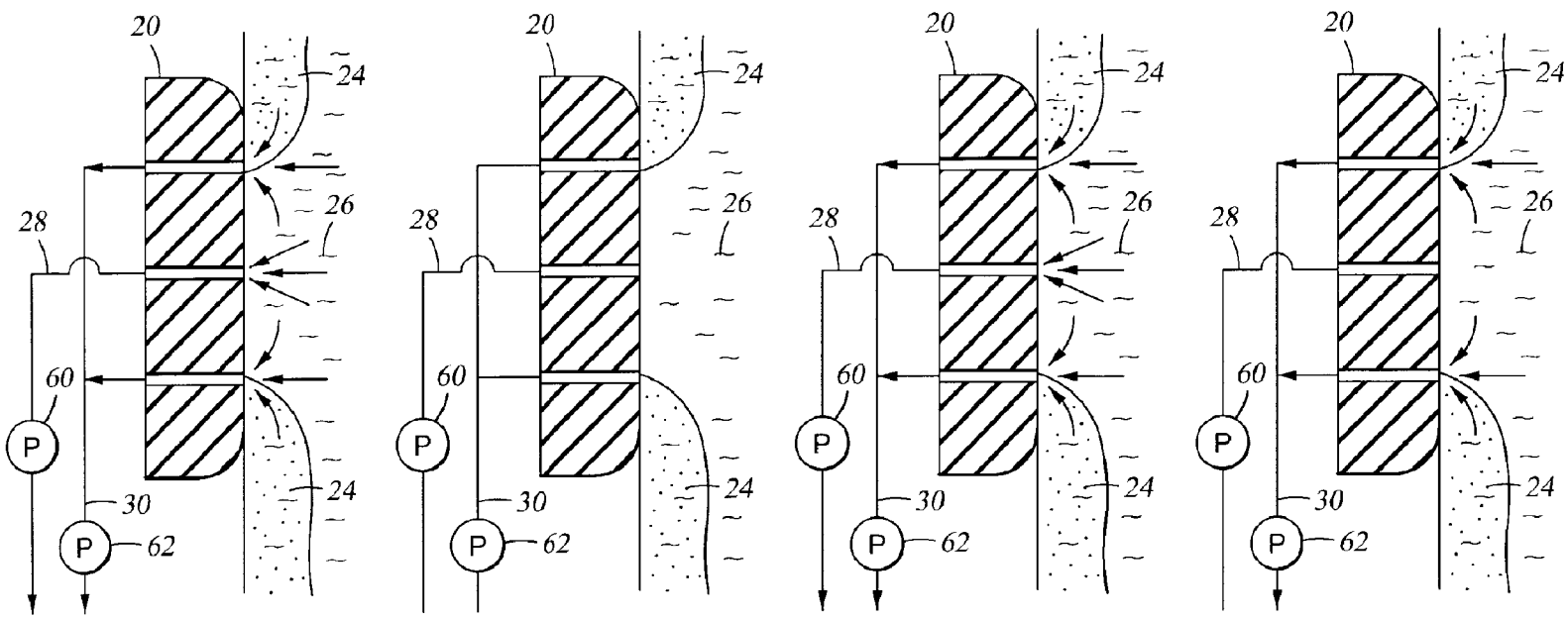
Fig. 6B1
Fig. 6B2
Fig. 6B3
Fig. 6B4

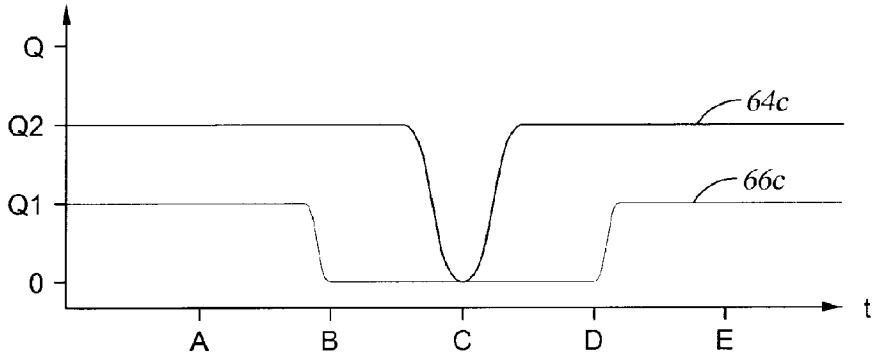
Fig. 7A
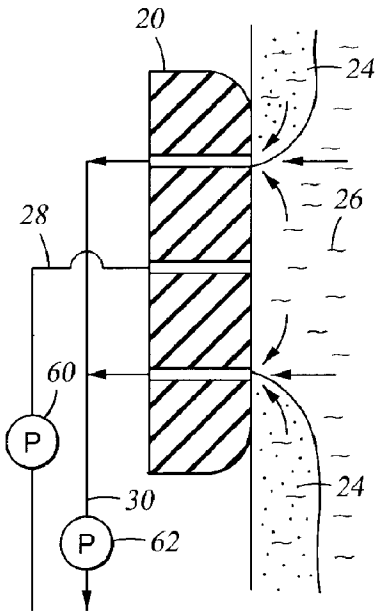
Fig. 7B2
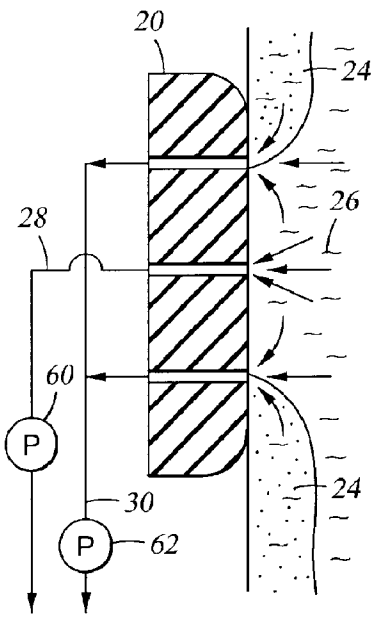
Fig. 7B1

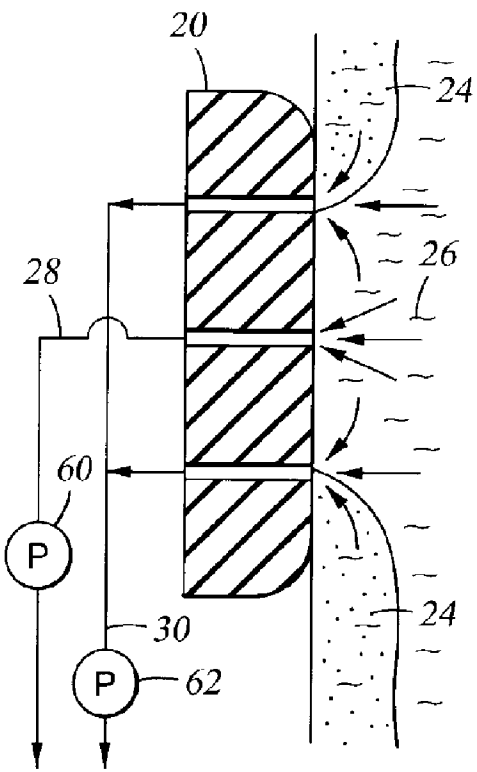
Fig. 7B5
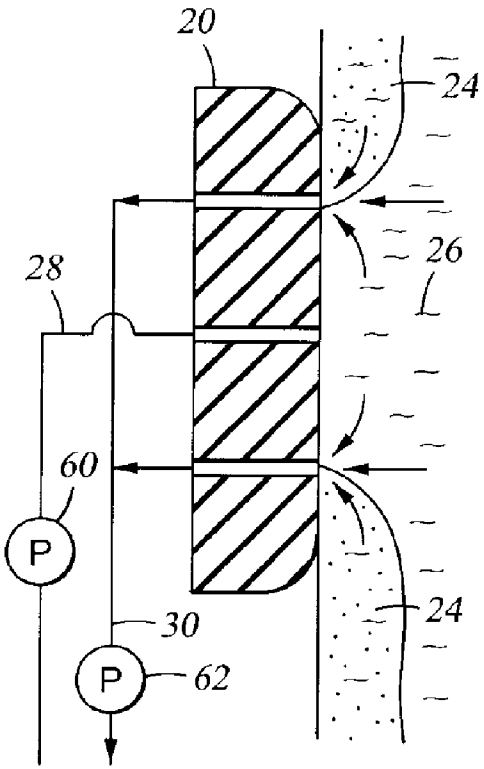
Fig. 7B4
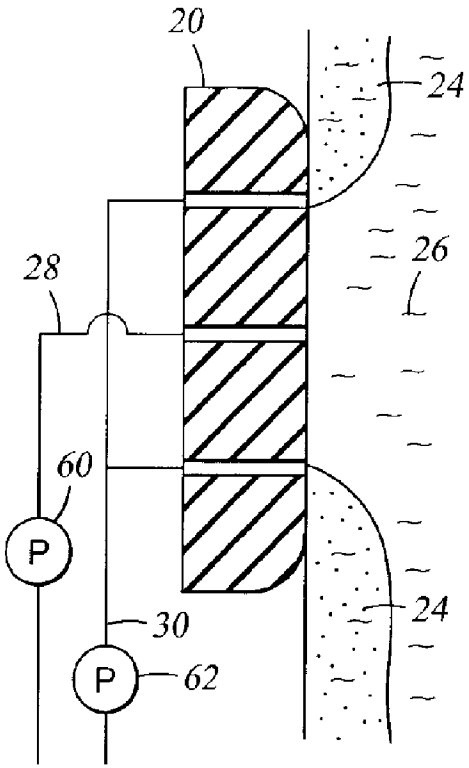
Fig. 7B3

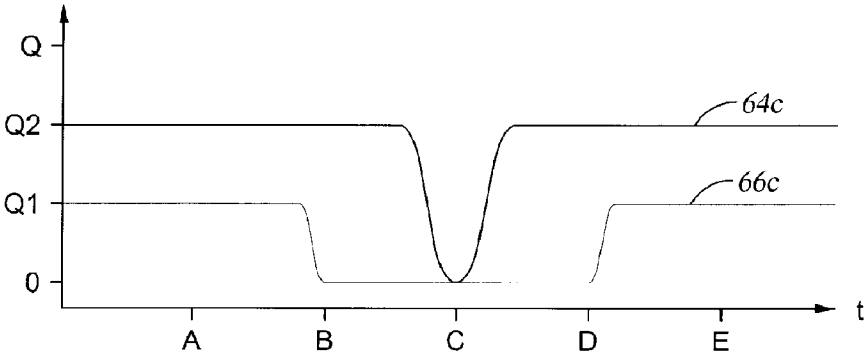
Fig. 8A
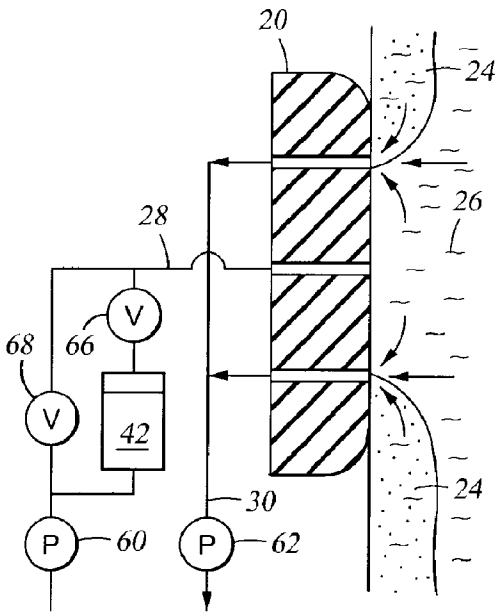
Fig. 8B2
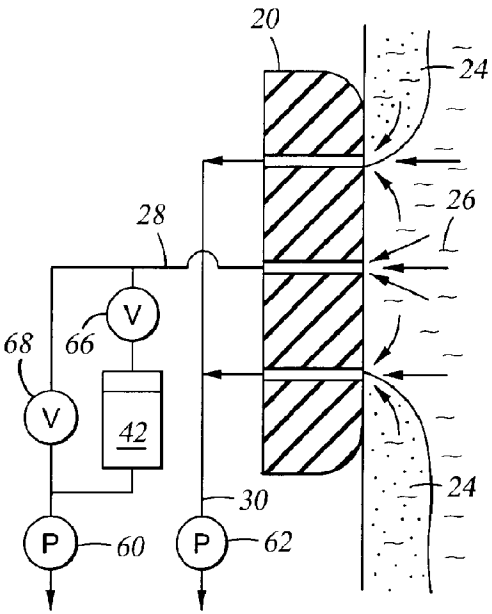
Fig. 8B1

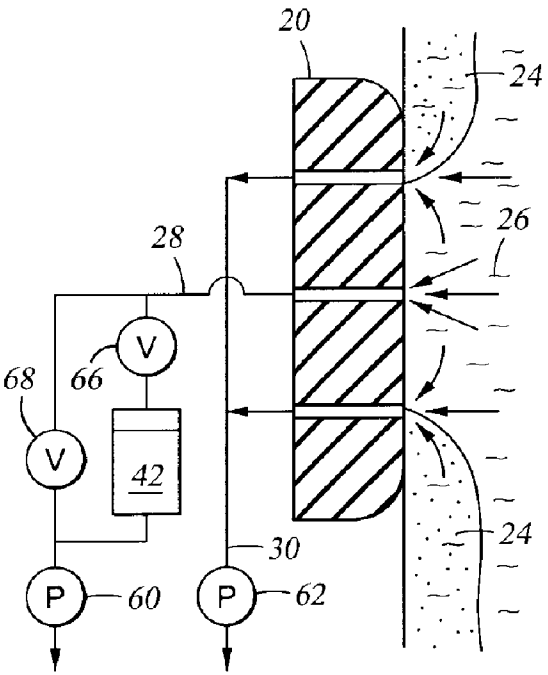
Fig. 8B5
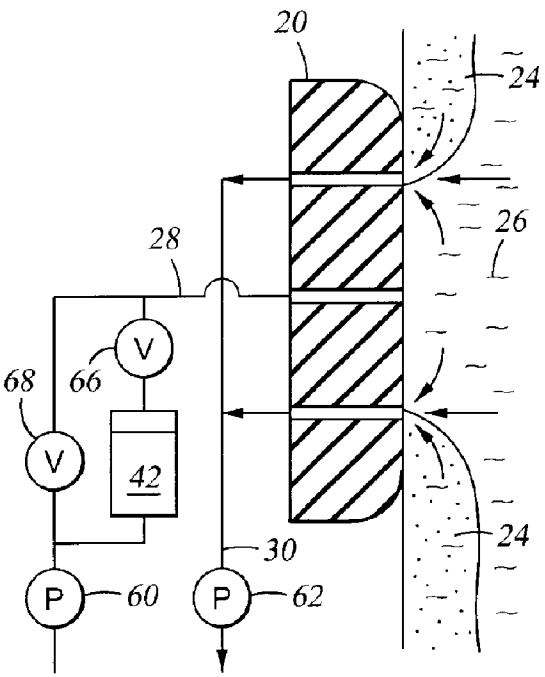
Fig. 8B4
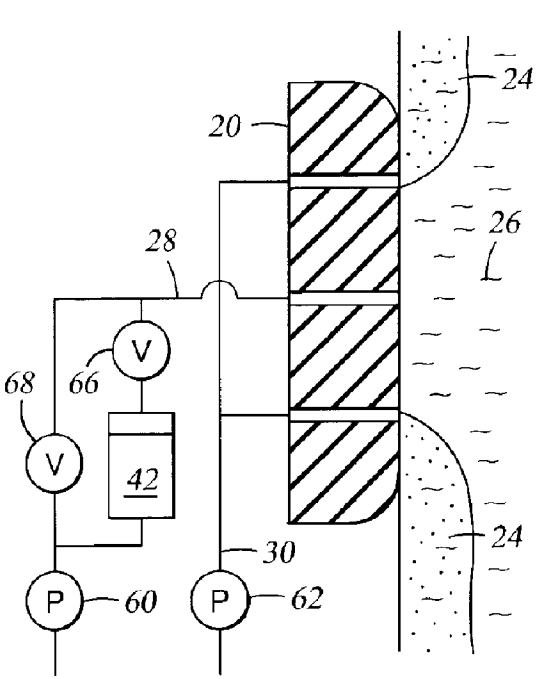
Fig. 8B3

APPARATUS AND METHOD FOR FORMATION EVALUATION

BACKGROUND OF THE INVENTION

1. Field of the Invention

The present invention relates to techniques for performing formation evaluation of a subterranean formation by a downhole tool positioned in a wellbore penetrating the subterranean formation. More particularly, the present invention relates to techniques for reducing the contamination of formation fluids drawn into and/or evaluated by the downhole tool.

2. Background of the Related Art

Wellbores are drilled to locate and produce hydrocarbons. A downhole drilling tool with a bit at and end thereof is advanced into the ground to form a wellbore. As the drilling tool is advanced, a drilling mud is pumped through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. In other cases, the drilling tool may be used to perform the testing or sampling. These samples or tests may be used, for example, to locate valuable hydrocarbons.

Formation evaluation often requires that fluid from the formation be drawn into the downhole tool for testing and/or sampling. Various devices, such as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device used to form a seal with the wellbore sidewall is referred to as a dual packer. With a dual packer, two elastomeric rings expand raidally about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making the seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568 and 6,719,049 and US Patent Application No. 2004/0000433.

Formation evaluation is typically performed on fluids drawn into the downhole tool. Techniques currently exist for performing various measurements, pretests and/or sample collection of fluids that enter the downhole tool. However, it has been discovered that when the formation fluid passes into the downhole tool, various contaminants, such as wellbore fluids and/or drilling mud, may enter the tool with the formation fluids. These contaminates may affect the quality of measurements and/or samples of the formation fluids.

Moreover, contamination may cause costly delays in the wellbore operations by requiring additional time for more testing and/or sampling. Additionally, such problems may yield false results that are erroneous and/or unusable.

It is, therefore, desirable that the formation fluid entering into the downhole tool be sufficiently 'clean' or 'virgin' for valid testing. In other words, the formation fluid should have little or no contamination. Attempts have been made to eliminate contaminates from entering the downhole tool with the formation fluid. For example, as depicted in U.S. Pat. No. 4,951,749, filters have been positioned in probes to block contaminates from entering the downhole tool with the formation fluid. Additionally, as shown in U.S. Pat. No. 6,301,959 to Hrametz, a probe is provided with a guard ring to divert contaminated fluids away from clean fluid as it enters the probe.

Despite the existence of techniques for performing formation evaluation and for attempting to deal with contamination, there remains a need to manipulate the flow of fluids through the downhole tool to reduce contamination as it enters and/or passed through the downhole tool. It is desirable that such techniques are capable of diverting contaminants away from clean fluid. It is further desirable that such techniques be capable of one of more of the following, among others: analyzing the fluid passing through the flowlines, selectively manipulating the flow of fluid through the downhole tool, responding to detected contamination, removing contamination and/or providing flexibility in handling fluids in the downhole tool.

SUMMARY OF THE INVENTION

In at least one aspect, the present invention relates to a reduced contamination formation evaluation system for a downhole tool positionable in a wellbore penetrating a subterranean formation having a virgin fluid and a contaminated fluid therein. The system is provided with at least two inlets for receiving the fluids from the formation, at least one evaluation flowline fluidly connected to at least one of the at least two inlets for passage of the virgin fluid into the downhole tool, at least one cleanup flowline fluidly connected to at least one of the inlets for passage of the contaminated fluid into the downhole tool, at least one fluid circuit fluidly connected to the evaluation and/or cleanup flowlines for selectively drawing fluid therein, at least one fluid connector for selectively establishing a fluid connection between the evaluation and/or cleanup flowlines and at least one sensor for measuring downhole parameters in the evaluation and/or cleanup flowlines.

In another aspect, the invention relates to a reduced contamination formation evaluation tool positionable in a wellbore penetrating a subterranean formation having a virgin fluid and a contaminated fluid therein. The tool is provided with a fluid communication device extendable from the housing for sealing engagement with a wall of the wellbore and having at least two inlets for receiving the fluids from the formation, at least one evaluation flowline positioned in the housing and fluidly connected to at least one of the inlets for passage of the virgin fluid into the downhole tool, at least one cleanup flowline fluidly connected to the inlets for passage of the contaminated fluid into the downhole tool, at least one fluid circuit fluidly connected to the evaluation and/or cleanup flowline for selectively drawing fluid therein, at least one fluid connector for selectively establishing a fluid connection between the evaluation and/or cleanup flowline and at least one sensor for measuring downhole parameters in the evaluation and/or cleanup flowlines.

In yet another aspect, the invention relates to a method of evaluating a subterranean formation having a virgin fluid and a contaminated fluid therein. The method involves a downhole tool having at least two inlets adapted to draw the fluids into at least one evaluation flowline and at least one cleanup flowline in the downhole tool. The tool is positioned in a wellbore penetrating the formation, fluid is selectively drawn into the evaluation and/or cleanup flowlines, a fluid connection is selectively established between the evaluation and the cleanup flowlines and downhole parameters of the fluids in the evaluation and/or cleanup flowlines are measured.

Finally, in another aspect, the invention relates to a method of drawing fluid into a downhole tool positionable in a wellbore penetrating a formation having a virgin fluid and a contaminated fluid therein. The method involves positioning a fluid communication device of the downhole tool in sealing engagement with a wall of the wellbore, establishing fluid communication between at least one evaluation flowline of the fluid communication device and the formation, establishing fluid communication between at least one cleanup flowline of the fluid communication device and the formation, pumping fluid into the cleanup flowline at a cleanup pump rate, pumping fluid into the evaluation flowline at an evaluation pump rate, selectively altering the cleanup pump and/or evaluation pump rate for a discrete time interval and performing formation evaluation of the fluid in the evaluation and/or cleanup flowline after the time interval.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIGS. 4B1–4 are schematic views of fluid flowing through the downhole tool of FIG. 2 at points A–D, respectively, of FIG. 4A.

FIGS. 5B1–4 are schematic views of fluid flowing through the downhole tool of FIG. 2 at points A–D, respectively, of FIG. 5A.

FIG. 6A is a graph depicting the flow rates of fluid through the downhole tool of FIG. 2 using partially synchronized pumping. FIGS. 6B1–4 schematic views of fluid flowing through the downhole tool of FIG. 2 at points A–D, respectively, of FIG. 6A.

FIG. 7A is a graph depicting the flow rates of fluid through the downhole tool of FIG. 2 using offset synchronized pumping. FIGS. 7B1–5 are schematic views of fluid flowing through the downhole tool of FIG. 2 at points A–E, respectively, of FIG. 7A.

FIG. 8A is a graph depicting the flow rates of fluid through the downhole tool of FIG. 7A further depicting flow into a sample chamber. FIGS. 8B1–5 are schematic views of fluid flowing through the downhole tool of FIG. 2 at points A–E, respectively, of FIG. 8A.

DETAILED DESCRIPTION OF THE INVENTION

Figure 1:
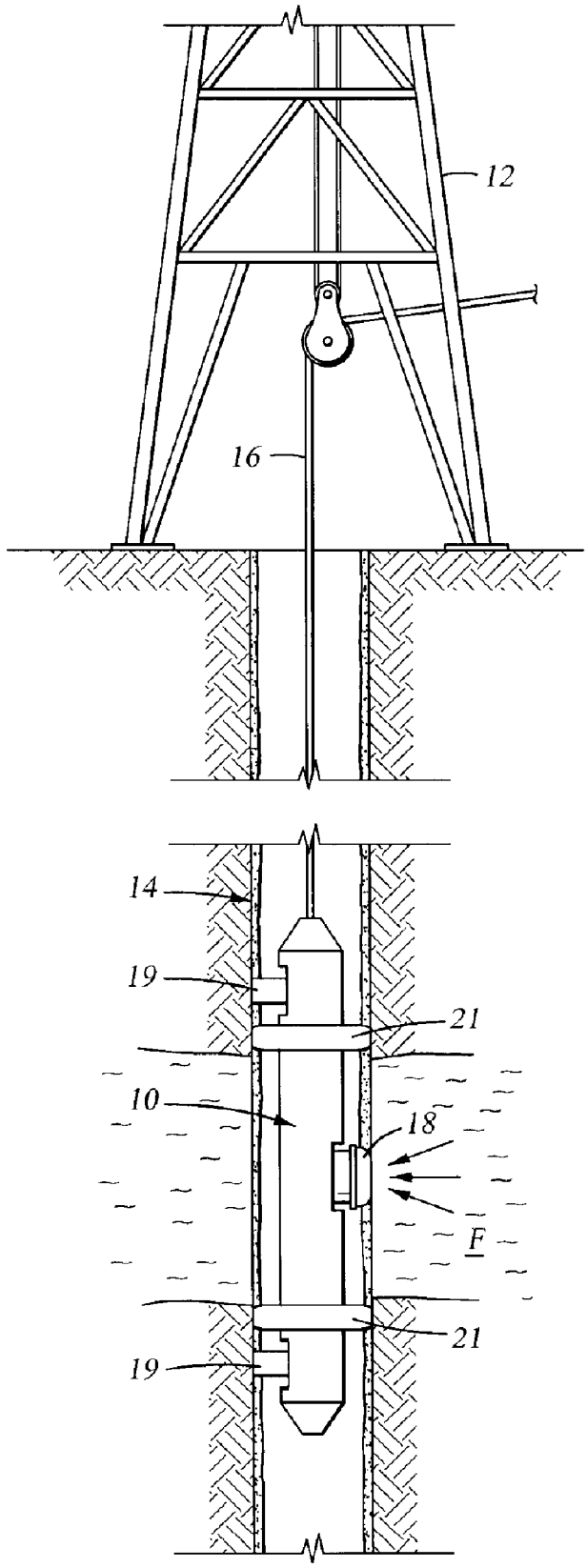
FIG. 1 is a schematic view, partially in cross-section of downhole formation evaluation tool positioned in a wellbore adjacent a subterranean formation.

Presently preferred embodiments of the invention are shown in the above—identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

FIG. 1 depicts a downhole tool usable in connection with the present invention. Any downhole tool capable of performing formation evaluation may be used, such as drilling, coiled tubing or other downhole tool. The downhole tool of FIG. 1 is a conventional wireline tool 10 deployed from a rig 12 into a wellbore 14 via a wireline cable 16 and positioned adjacent a formation F. The downhole tool 10 is provided with a probe 18 adapted to seal with the wellbore wall and draw fluid from the formation into the downhole tool. Dual packers 21 are also depicted to demonstrate that various fluid communication devices, such as probes and/or packers, may be used to draw fluid into the downhole tool. Backup pistons 19 assist in pushing the downhole tool and probe against the wellbore wall.

Figure 2:
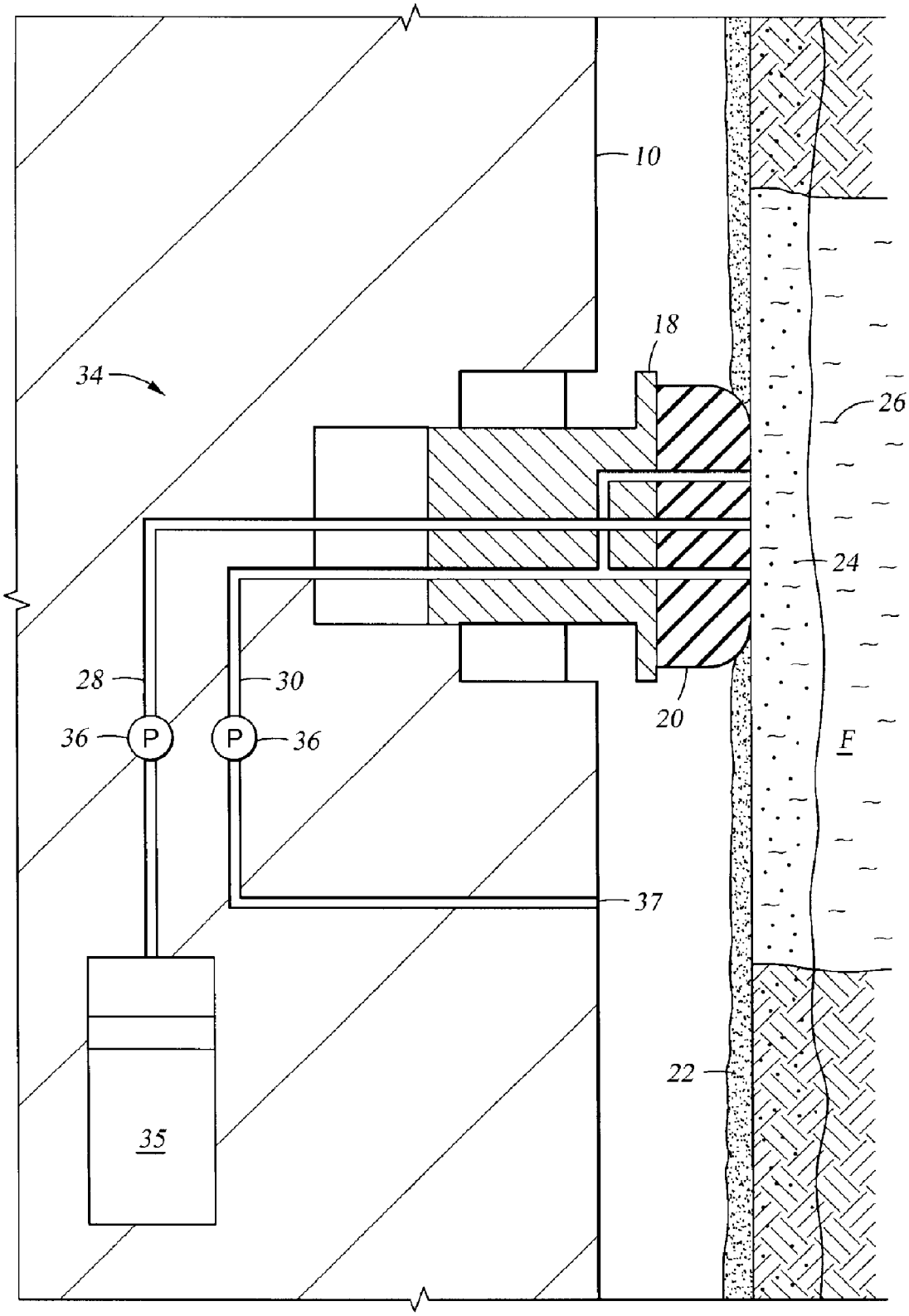
FIG. 2 is a schematic view of a portion of the downhole formation evaluation tool of FIG. 1 depicting a fluid flow system for receiving fluid from the adjacent formation.

FIG. 2 is a schematic view of a portion of the downhole tool 10 of FIG. 1 depicting a fluid flow system 34. The probe 18 is preferably extended from the downhole tool for engagement with the wellbore wall. The probe is provided with a packer 20 for sealing with the wellbore wall. The packer contacts the wellbore wall and forms a seal with the mudcake 22 lining the wellbore. The mudcake seeps into the wellbore wall and creates an invaded zone 24 about the wellbore. The invaded zone contains mud and other wellbore fluids that contaminate the surrounding formations, including the formation F and a portion of the clean formation fluid 26 contained therein.

The probe 18 is preferably provided with at least two flowlines, an evaluation flowline 28 and a cleanup flowline 30. It will be appreciated that in cases where dual packers are used, inlets may be provided therebetween to draw fluid into the evaluation and cleanup flowlines in the downhole tool. Examples of fluid communication devices, such as probes and dual packers, used for drawing fluid into separate flowlines are depicted in U.S. Pat. application Ser. No. 6,719,049 and US Published Application No. 20040000433, assigned to the assignee of the present invention, and U.S. Pat. No. 6,301,959 assigned to Halliburton.

The evaluation flowline extends into the downhole tool and is used to pass clean formation fluid into the downhole tool for testing and/or sampling. The evaluation flowline extends to a sample chamber 35 for collecting samples of formation fluid. The cleanup flowline 30 extends into the downhole tool and is used to draw contaminated fluid away from the clean fluid flowing into the evaluation flowline. Contaminated fluid may be dumped into the wellbore through an exit port 37. One or more pumps 36 may be used to draw fluid through the flowlines. A divider or barrier is preferably positioned between the evaluation and cleanup flowlines to separate the fluid flowing therein.

Figure 3:
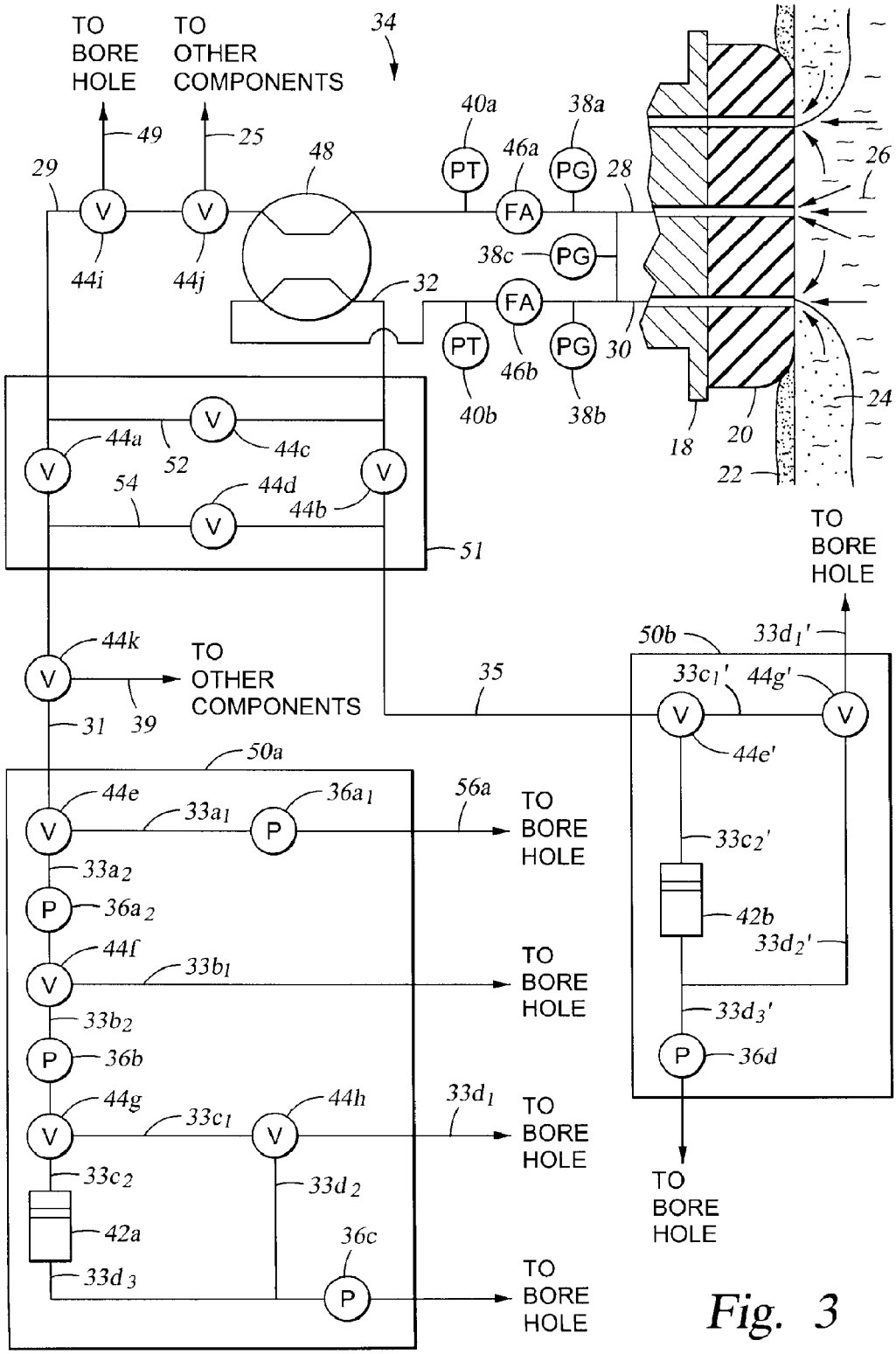
FIG. 3 is a schematic, detailed view of the downhole tool and fluid flow system of FIG. 2.

Referring now to FIG. 3, the fluid flow system 34 of FIG. 2 is shown in greater detail. In this figure, fluid is drawn into the evaluation and cleanup flowlines through probe 18. As fluid flows into the tool, the contaminated fluid in the invaded zone 24 (FIG. 2) breaks through so that the clean fluid 26 may enter the evaluation flowline 28 (FIG. 3). Contaminated fluid is drawn into the cleanup line and away from the evaluation flowline as shown by the arrows. FIG. 3 depicts the probe as having a cleanup flowline that forms a ring about the surface of the probe. However, it will be appreciated that other layouts of one or more intake and flowlines extending through the probe may be used.

The evaluation and cleanup flowlines 28, 30 extend from the probe 18 and through the fluid flow system 34 of the downhole tool. The evaluation and cleanup flowlines are in selective fluid communication with flowlines extending through the fluid flow system as described further herein. The fluid flow system of FIG. 3 includes a variety of features for manipulating the flow of clean and/or contaminated fluid as it passes from an upstream location near the formation to a downstream location through the downhole tool. The system is provided with a variety of fluid measuring and/or manipulation devices, such as flowlines (28, 29, 30, 31, 32, 33, 35), pumps 36, pretest pistons 40, sample chambers 42, valves 44, fluid connectors (48, 51) and sensors (38, 46). The system may also provided with a variety of additional devices, such as restrictors, diverters, processors and other devices for manipulating flow and/or performing various formation evaluation operations.

Evaluation flowline 28 extends from probe 18 and fluidly connects to flowlines extending through the downhole tool. Evaluation flowline 28 is preferably provided with a pretest piston 40*a* and sensors, such as pressure gauge 38*a* and a fluid analyzer 46*a*. Cleanup flowline 30 extends from probe 18 and fluidly connects to flowlines extending through the downhole tool. Cleanup flowline 30 is preferably provided with a pretest piston 40*b* and sensors, such as a pressure gauge 38*b* and a fluid analyzer 46*b*. Sensors, such as pressure gauge 38*c*, may be connected to evaluation and cleanup flowlines 28 and 30 to measure parameters therebetween, such as differential pressure. Such sensors may be located in other positions along any of the flowlines of the fluid flow system as desired.

One or more pretest piston may be provided to draw fluid into the tool and perform a pretest operation. Pretests are typically performed to generate a pressure trace of the drawdown and buildup pressure in the flowline as fluid is drawn into the downhole tool through the probe. When used in combination with a probe having an evaluation and cleanup flowline, the pretest piston may be positioned along each flowline to generate curves of the formation. These curves may be compared and analyzed. Additionally, the pretest pistons may be used to draw fluid into the tool to break up the mudcake along the wellbore wall. The pistons may be cycled synchronously, or at disparate rates to align and/or create pressure differentials across the respective flowlines.

The pretest pistons may also be used to diagnose and/or detect problems during operation. Where the pistons are cycled at different rates, the integrity of isolation between the lines may be determined. Where the change in pressure across one flowline is reflected in a second flowline, there may be an indication that insufficient isolation exists between the flowlines. A lack of isolation between the flowlines may indicate that an insufficient seal exists between the flowlines. The pressure readings across the flowlines during the cycling of the pistons may be used to assist in diagnosis of any problems, or verification of sufficient operability.

The fluid flow system may be provided with fluid connectors, such as crossover 48 and/or junction 51, for passing fluid between the evaluation and cleanup flowlines (and/or flowlines fluidly connected thereto). These devices may be positioned at various locations along the fluid flow system to divert the flow of fluid from one or more flowlines to desired components or portions of the downhole tool. As shown in FIG. 3, a rotatable crossover 48 may be used to fluidly connect evaluation flowline 28 with flowline 32, and cleanup flowline 30 with flowline 29. In other words, fluid from the flowlines may selectively be diverted between various flowlines as desired. By way of example, fluid may be diverted from flowline 28 to flow circuit 50*b*, and fluid may be diverted from flowline 30 to flow circuit 50*a*.

Junction 51 is depicted in FIG. 3 as containing a series of valves 44*a, b, c, d* and associated connector flowlines 52 and 54. Valve 44*a* permits fluid to pass from flowline 29 to connector flowline 54 and/or through flowline 31 to flow circuit 50*a*. Valve 44*b* permits fluid to pass from flowline 32 to connector flowline 54 and/or through flowline 35 to flow circuit 50*b*. Valve 44*c* permits fluid to flow between flowlines 29, 32 upstream of valves 44*a* and 44*b*. Valve 44*d* permits fluid to flow between flowlines 31, 35 downstream of valves 44*a* and 44*b*. This configuration permits the selective mixing of fluid between the evaluation and cleanup flowlines. This may be used, for example, to selectively pass fluid from the flowlines to one or both of the sampling circuits 50*a, b*.

Valves 44*a* and 44*b* may also be used as isolation valves to isolate fluid in flowline 29, 32 from the remainder of the fluid flow system located downstream of valves 44*a, b*. The isolation valves are closed to isolate a fixed volume of fluid within the downhole tool (i.e. in the flowlines between the formation and the valves 44*a, b*). The fixed volume located upstream of valve 44*a* and/or 44*b* is used for performing downhole measurements, such as pressure and mobility.

In some cases, it is desirable to maintain separation between the evaluation and cleanup flowlines, for example during sampling. This may be accomplished, for example, by closing valves 44*c* and/or 44*d* to prevent fluid from passing between flowlines 29 and 32, or 31 and 35. In other cases, fluid communication between the flowlines may be desirable for performing downhole measurements, such as formation pressure and/or mobility estimations. This may be accomplished for example by closing valves 44*a, b*, opening valves 44*c* and/or 44*d* to allow fluid to flow across flowlines 29 and 32 or 31 and 35, respectively. As fluid flows into the flowlines, the pressure gauges positioned along the flowlines can be used to measure pressure and determine the change in volume and flow area at the interface between the probe and formation wall. This information may be used to generate the formation mobility.

Valves 44*c, d* may also be used to permit fluid to pass between the flowlines inside the downhole tool to prevent a pressure differential between the flowlines. Absent such a valve, pressure differentials between the flowlines may cause fluid to flow from one flowline, through the formation and back into another flowline in the downhole tool, which may alter measurements, such as mobility and pressure.

Junction 51 may also be used to isolate portions of the fluid flow system downstream thereof from a portion of the fluid flow system upstream thereof. For example, junction 51 (i.e. by closing valves 44*a, b*) may be used to pass fluid from a position upstream of the junction to other portions of the downhole tool, for example through valve 44*j* and flowline 25 thereby avoiding the fluid flow circuits. In another example, by closing valves 44*a, b* and opening valve d, this configuration may be used to permit fluid to pass between the fluid circuits 50 and/or to other parts of the downhole tool through valve 44*k* and flowline 39. This configuration may also be used to permit fluid to pass between other components and the fluid flow circuits without being in fluid communication with the probe. This may be useful in cases, for example, where there are additional components, such as additional probes and/or fluid circuit modules, downstream of the junction.

Junction 51 may also be operated such that valve 44*a* and 44*d* are closed and 44*b* and 44*d* are open. In this configuration, fluid from both flowlines may be passed from a position upstream of junction 51 to flowline 35. Alternatively, valves 44*b* and 44*d* may be closed and 44*a* and 44*c* are open so that fluid from both flowlines may be passed from a position upstream of junction 51 to flowline 31.

The flow circuits 50*a* and 50*b* (sometimes referred to as sampling or fluid circuits) preferably contain pumps 36, sample chamber 42, valves 44 and associated flowlines for selectively drawing fluid through the downhole tool. One or more flow circuits may be used. For descriptive purposes, two different flow circuits are depicted, but identical or other variations of flow circuits may be employed.

Flowline 31 extends from junction 51 to flow circuit 50*a*. Valve 44*e* is provided to selectively permit fluid to flow into the flow circuit 50*a*. Fluid may be diverted from flowline 31, past valve 44*e* to flowline 33*a*1 and to the borehole through exit port 56*a*. Alternatively, fluid may be diverted from flowline 31, past valve 44*e* through flowline 33*a*2 to valve 44*f*. Pumps 36*a*1 and 36*a*2 may be provided in flowlines 33*a*1 and 33*a*2, respectively.

Fluid passing through flowline 33*a*2 may be diverted via valve 44*f* to the borehole via flowline 33*b*1, or to valve 44*g* via flowline 33*b*2. A pump 36*b* may be positioned in flowline 33*b*2.

Fluid passing through flowline 33*b*2 may be passed via valve 44*g* to flowline 33*c*1 or flowline 33*c*2. When diverted to flowline 33*c*1, fluid may be passed via valve 44*h* to the borehole through flowline 33*d*1, or back through flowline 33*d*2. When diverted through flowline 33*c*2, fluid is collected in sample chamber 42*a*. Buffer flowline 33*d*3 extends to the borehole and/or fluidly connects to flowline 33*d*2. Pump 36*c* is positioned in flowline 33*d*3 to draw fluid therethrough.

Flow circuit 50*b* is depicted as having a valve 44*e*' for selectively permitting fluid to flow from flowline 35 into flow circuit 50*b*. Fluid may flow through valve 44*e*' into flowline 33*c*1', or into flowline 33*c*2' to sample chamber 42*b*. Fluid passing through flowline 33*c*1' may be passed via valve 44*g*' to flowline 33*d*1' and out to the borehole, or to flowline 33*d*2'. Buffer flowline 33*d*3' extends from sample chamber 42*b* to the borehole and/or fluidly connects to flowline 33*d*2'. Pump 36*d* is positioned in flowline 33*d*3' to draw fluid therethrough.

A variety of flow configurations may be used for the flow control circuit. For example, additional sample chambers may be included. One or more pumps may be positioned in one or more flowlines throughout the circuit. A variety of valving and related flowlines may be provided to permit pumping and diverting of fluid into sample chambers and/or the wellbore.

The flow circuits may be positioned adjacently as depicted in FIG. 3. Alternatively, all or portions of the flow circuits may be positioned about the downhole tool and fluidly connected via flowlines. In some cases, portions of the flow circuits (as well as other portions of the tool, such as the probe) may be positioned in modules that are connectable in various configurations to form the downhole tool. Multiple flow circuits may be included in a variety of locations and/or configurations. One or more flowlines may be used to connect to the one or more flow circuits throughout the downhole tool.

An equalization valve 44*i* and associated flowline 49 are depicted as being connected to flowline 29. One or more such equalization valves may be positioned along the evaluation and/or cleanup flowlines to equalize the pressure between the flowline and the borehole. This equalization allows the pressure differential between the interior of the tool and the borehole to be equalized, so that the tool will not stick against the formation. Additionally, an equalization flowline assists in assuring that the interior of the flowlines is drained of pressurized fluids and gases when it rises to the surface. This valve may exist in various positions along one or more flowlines. Multiple equalization valves may be put inserted, particularly where pressure is anticipated to be trapped in multiple locations. Alternatively, other valves 44 in the tool may be configured to automatically open to allow multiple locations to equalize pressure.

A variety of valves may be used to direct and/or control the flow of fluid through the flowlines. Such valves may include check valves, crossover valves, flow restrictors, equalization, isolation or bypass valves and/or other devices capable of controlling fluid flow. Valves 44*a–k* may be on-off valves that selectively permit the flow of fluid through the flowline. However, they may also be valves capable of permitting a limited amount of flow therethrough. Crossover 48 is an example of a valve that may be used to transfer flow from the evaluation flowline 28 to the first sampling circuit and to transfer flow from the cleanup flowline to the second sampling circuit, and then switch the sampling flowing to the second sampling circuit and the cleanup flowline to the first sampling circuit.

One or more pumps may be positioned across the flowlines to manipulate the flow of fluid therethrough. The position of the pump may be used to assist in drawing fluid through certain portions of the downhole tool. The pumps may also be used to selectively flow fluid through one or more of the flowlines at a desired rate and/or pressure. Manipulation of the pumps may be used to assist in determining downhole formation parameters, such as formation fluid pressure, formation fluid mobility, etc. The pumps are typically positioned such that the flowline and valving may be used to manipulate the flow of fluid through the system. For example, one or more pumps may be upstream and/or downstream of certain valves, sample chambers, sensors, gauges or other devices.

The pumps may be selectively activated and/or coordinated to draw fluid into each flowline as desired. For example, the pumping rate of a pump connected to the cleanup flowline may be increased and/or the pumping rate of a pump connected to the evaluation flowline may be decreased, such that the amount of clean fluid drawn into the evaluation flowline is optimized. One or more such pumps may also be positioned along a flowline to selectively increase the pumping rate of the fluid flowing through the flowline.

One or more sensors, such as the fluid analyzers 46*a, b* (i.e. the fluid analyzers described in U.S. Pat. No. 4,994,671 and assigned to the assignee of the present invention) and pressure gauges 38*a, b, c*, may be provided. A variety of sensors may be used to determine downhole parameters, such as content, contamination levels, chemical (e.g., percentage of a certain chemical/substance), hydro mechanical (viscosity, density, percentage of certain phases, etc.), electromagnetic (e.g., electrical resistivity), thermal (e.g., temperature), dynamic (e.g., volume or mass flow meter), optical (absorption or emission), radiological, pressure, temperature, Salinity, Ph, Radioactivity (Gamma and Neutron, and spectral energy), Carbon Content, Clay Composition and Content, Oxygen Content, and/or other data about the fluid and/or associated downhole conditions, among others. Sensor data may be collected, transmitted to the surface and/or processed downhole.

Preferably, one or more of the sensors are pressure gauges 38 positioned in the evaluation flowline (38*a*), the cleanup flowline (38*b*) or across both for differential pressure therebetween (38*c*). Additional gauges may be positioned at various locations along the flowlines. The pressure gauges maybe used to compare pressure levels in the respective flowlines, for fault detection, or for other analytical and/or diagnostic purposes. Measurement data may be collected, transmitted to the surface and/or processed downhole. This data, alone or in combination with the sensor data may be used to determine downhole conditions and/or make decisions.

One or more sample chambers may be positioned at various positions along the flowline. A single sample chamber with a piston therein is schematically depicted for simplicity. However, it will be appreciated that a variety of one or more sample chambers may be used. The sample chambers may be interconnected with flowlines that extend to other sample chambers, other portions of the downhole tool, the borehole and/or other charging chambers. Examples of sample chambers and related configures may be seen in U.S. Patent/Application No. 2003042021, U.S. Pat. Nos. 6,467,544 and 6,659,177, assigned to the assignee of the present invention. Preferably, the sample chambers are positioned to collect clean fluid. Moreover, it is desirable to position the sample chambers for efficient and high quality receipt of clean formation fluid. Fluid from one or more of the flowlines may be collected in one or more sample chambers and/or dumped into the borehole. There is no requirement that a sample chamber be included, particularly for the cleanup flowline that may contain contaminated fluid.

In some cases, the sample chambers and/or certain sensors, such as a fluid analyzer, may be positioned near the probe and/or upstream of the pump. It is often beneficial to sense fluid parameters from a point closer to the formation, or the source of the fluid. It may also be beneficial to test and/or sample upstream of the pump. The pump typically agitates the fluid passing through the pump. This agitation can spread the contamination to fluid passing through the pump and/or increase the amount of time before a clean sample may be obtained. By testing and sampling upstream of the pump, such agitation and spread of contamination may be avoided.

Computer or other processing equipment is preferably provided to selectively activate various devices in the system. The processing equipment may be used to collect, analyze, assemble, communicate, respond to and/or otherwise process downhole data. The downhole tool may be adapted to perform commands in response to the processor. These commands may be used to perform downhole operations.

In operation, the downhole tool 10 (FIG. 1) is positioned adjacent the wellbore wall and the probe 18 is extended to form a seal with the wellbore wall. Backup pistons 19 are extended to assist in driving the downhole tool and probe into the engaged position. One or more pumps 36 in the downhole tool are selectively activated to draw fluid into one or more flowlines (FIG. 3). Fluid is drawn into the flowlines by the pumps and directed through the desired flowlines by the valves.

Figure 4A:
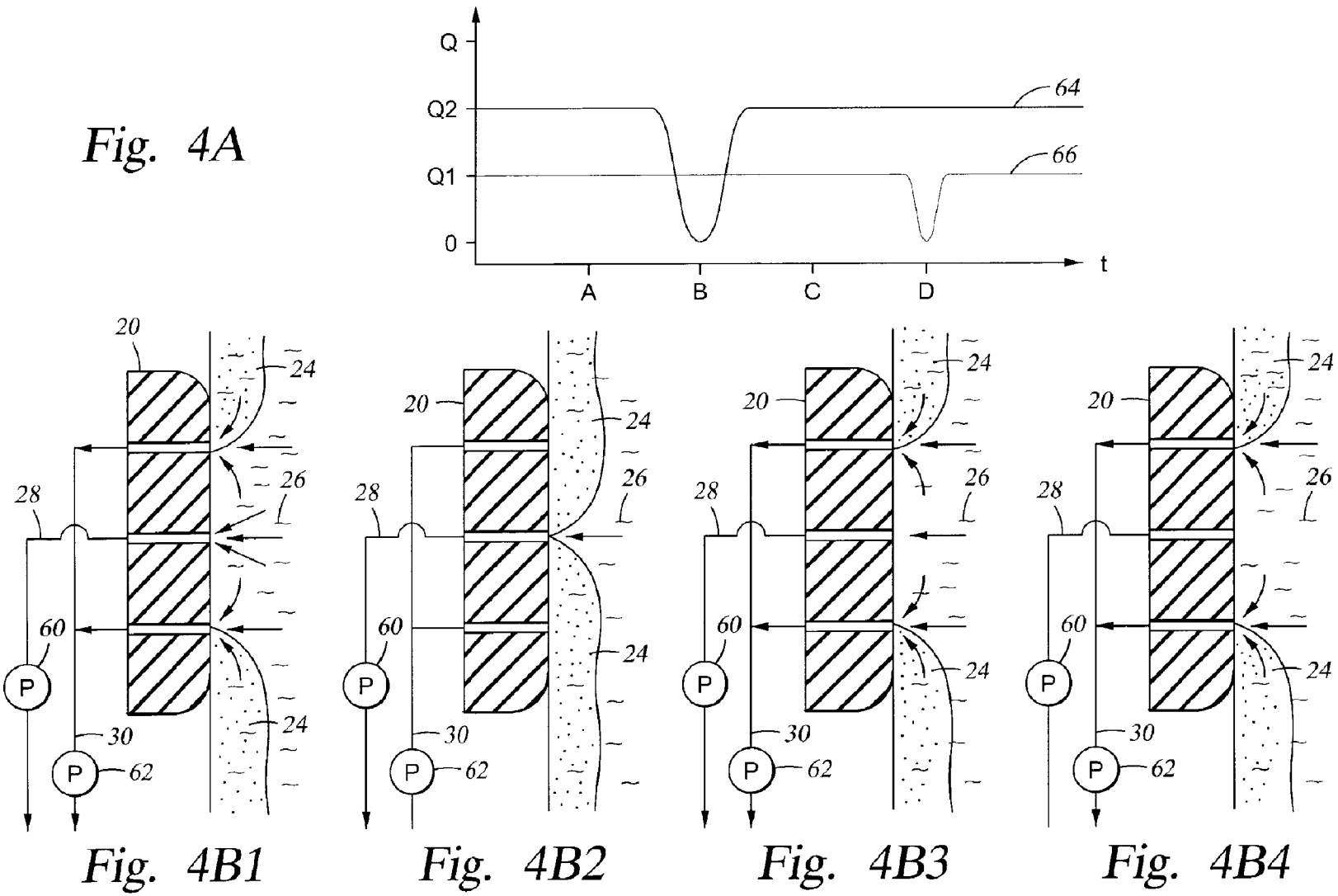
FIG. 4A is a graph depicting the flow rates of fluid through the downhole tool of FIG. 2 using unsynchronized pumping.

FIGS. 4A–8B5 depict the flow of fluid into a probe having multiple flowlines, such as in the fluid flow system of FIGS. 2 and/or 3. These figures demonstrate techniques for manipulating the flow of fluid into the tool to facilitate the flow of clean fluid into the evaluation flowline and reduce contamination. In each figure, the flow of fluid into the probe 18 and through evaluation flowline 28 and cleanup flowline 30 are depicted. Pumps 60, 62 are schematically depicted as being operatively connected to flowlines 28, 30, respectively for drawing fluid therethrough. Pump 62 is depicted as operating at a higher rate than the evaluation pump 60. However, it will be appreciated that the pumps may be operated at the same rate, or the cleanup pump may be operated at a higher rate than the evaluation pump. For depiction purposes, only one pump is shown for each flowline. However, any number of pumps across either flowline may be used. These pumps may be the same as the pumps 36 of FIG. 3.

Referring to FIGS. 4A–4B4, pumps 60, 62 are depicted as operating in an unsynchronized mode. FIG. 4A shows a graph of the flow rate Q (y axis) versus time t (x axis) of fluid passing through the evaluation flowline 28 and the cleanup flowline 30, represented by lines 66 and 64, respectively. FIGS. 4B1–B4 depict the operation of the pumps and the flow of fluid into the probe at points A–D, respectively, of the graph of FIG. 4A.

At point A on FIG. 4A, the pumps are both operating and drawing fluid into the respective evaluation and cleanup flowlines. As depicted in FIG. 4A1, a portion of the formation fluid passes into the evaluation flowline, and a portion of the fluid passes into the cleanup flowline. Preferably, the contaminated fluid 24 is drawn into the cleanup flowline so that only clean fluid 26 flows into the evaluation flowline as indicated by the arrows.

At point B in FIG. 4A, the cleanup pump is stopped, but the evaluation pump continues pumping. The corresponding flow rates of the pumps at Point B show that the flow rate (64) through the cleanup flowline has dropped, while the flow rate (66) through the evaluation flowline continues. As shown in FIG. 4B2, contaminated fluid is no longer being drawn into the cleanup line and away from the evaluation flowline. In this case, both contaminated and clean fluid may be drawn into the evaluation flowline as indicated by the arrows.

At point C in FIG. 4A, both pumps are pumping and the flow rate 64 of the cleanup line increases. As shown in FIG. 4A3, the pumps return to operation as previously described with respect to point A.

At point D in FIG. 4A, the cleanup pump is pumping, but the evaluation pump is stopped. The corresponding flow rates of the pumps at Point D show that the flow rate (64) through the cleanup flowline continues, while the flow rate (66) through the evaluation flowline has dropped. As shown in FIG. 4B4, fluid is no longer being drawn into the evaluation flowline. In this case, both contaminated and clean fluid may be drawn into the cleanup flowline as indicated by the arrows.

Figure 5A:
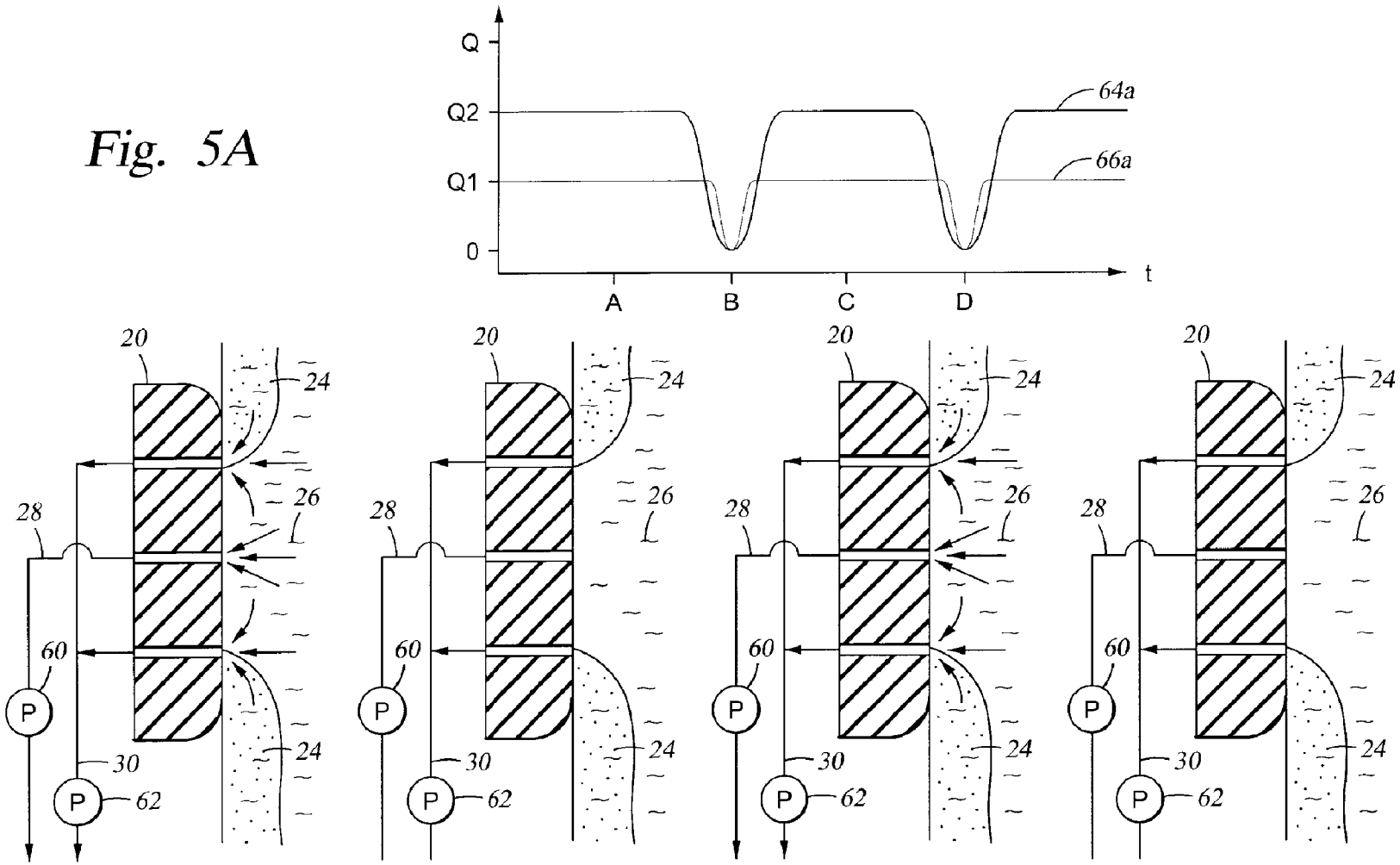
FIG. 5A is a graph depicting the flow rates of fluid through the downhole tool of FIG. 2 using synchronized pumping.

Referring to FIGS. 5A–5B4, the pumps 60, 62 are depicted operating in a synchronized mode. These Figures are the same as FIGS. 4A–4B4, except that both pumps are turned off at points B and D. At points B and D of FIG. 5A, the flow rates 64*a*, 66*a* both drop as the pumps are stopped. As shown in FIGS. 5B2 and 4, fluid stops flowing into either flowline when the pumps are stopped.

Referring to FIGS. 6A–6B4, the pumps 60, 62 are depicted operating in a partially synchronized mode. These Figures are the same as FIGS. 4A–4B4, except that both pumps are turned off at point B. At point B of FIG. 6A, the flow rates 64*b*, 66*b* both drop as the pumps are stopped. As shown in FIG. 6B2, fluid stops flowing into either flowline.

Referring to FIGS. 7A–7B5, the pumps 60, 62 are depicted operating in an offset synchronized mode. FIGS. 7A–7B5 are the same as FIGS. 4A–4B4, except that at point B, the cleanup pump is on and the evaluation pump is off, at point C both pumps are off, and at point D the cleanup pump is on and the evaluation pump is off. Additionally, an additional point E is depicted with both pumps on. The resulting curves 64*c*, 66*c* in FIG. 7A show that the flow rate through the cleanup flowline drops at point C, while the flow rate through the evaluation flowline drops for an extended time from points B to D.

Referring to FIGS. 8A–8B5, a pumping and sampling operation is depicted. In this case, the pumps 60, 62 are depicted operating in the offset synchronized mode of FIGS. 7A–7B5. However, the sampling operation may be performed with any of the modes described. These Figures are the same as FIGS. 7A–7B5, except that a sample chamber 42 is connected to the evaluation flowline in FIGS. 8B1–5. Valves 66 and 68 are depicted along flowline 28 to selectively divert fluid to the sample chamber.

The valves are preferably activated and/or fluid is delivered into the sample chamber at a point when clean fluid is present in the evaluation flowline. In the mode described in FIGS. 8A–8B5, sampling is performed after the pumps have been cycled to assure the flow of clean fluid into the evaluation flowline 28. As shown in FIGS. 8B1–3, the valve 66 is closed and valve 68 is open at points A–C of the pumping operation. As shown in FIG. 8B4, at point D, valve 66 is opened and valve 68 is closed to permit fluid to start to flow into sample chamber 42. As shown at point E and in FIG. 8B5, fluid begins flowing into the sample chamber.

FIGS. 8A–8B5 depict a given sampling operation used in combination with a pumping mode. The sampling operation may also be used in combination with other pumping modes, such as those depicted in FIGS. 4–6. It is preferred that such pumping and sampling be manipulated to draw clean fluid into the sample chamber and/or contaminated fluid away therefrom. Fluid may be monitored through the flowlines to detect contamination. Where contamination occurs, fluid may be diverted from the sample chamber, for example to the wellbore.

Pressure in the flowlines may also be manipulated using other device to increase and/or lower pressure in one or more flowlines. For example, pistons in the sample chambers and pretest may be retracted to draw fluid therein. Charging, valving, hydrostatic pressure and other techniques may also be used to manipulate pressure in the flowlines.

It will be understood from the foregoing description that various modifications and changes may be made in the preferred and alternative embodiments of the present invention without departing from its true spirit. The devices included herein may be manually and/or automatically activated to perform the desired operation. The activation as desired and/or based on data generated, conditions detected and/or analysis of results from downhole operations.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A formation evaluation system for a downhole tool positionable in a wellbore penetrating a subterranean formation, the formation having a virgin fluid and a contaminated fluid therein, comprising:

at least two inlets for receiving the fluids from the formation;

at least one evaluation flowline fluidly connected to at least one of the at least two inlets for passage of the virgin fluid into the downhole tool;

at least one cleanup flowline fluidly connected to at least one of the at least two inlets for passage of the contaminated fluid into the downhole tool;

at least one fluid circuit fluidly connected to one of the at least one evaluation flowline, the at least one cleanup flowline and combinations thereof for selectively drawing fluid therein;

at least one fluid connector for selectively establishing a fluid connection between the at least one evaluation flowline and the at least one cleanup flowline; and at least one sensor for measuring downhole parameters in one of the at least one evaluation flowline, the at least one cleanup flowline and combinations thereof.

2. The formation evaluation system of claim 1 wherein the at least one fluid connector is adapted to one of pass fluid from an upstream portion of the at least one evaluation flowline to a downstream portion of the at least one cleanup flowline, pass fluid from an upstream portion of the at least one cleanup flowline to a downstream portion of the at least one sample flowline and combinations thereof.

3. The formation evaluation system of claim 1 wherein the at least one fluid connector is connected to the flowlines at a position upstream of one of an evaluation flowline shutoff valve, a cleanup flowline shutoff valve and combinations thereof.

4. The formation evaluation system of claim 3 wherein the at least one fluid connector is connected to the flowlines at a position downstream of one of an evaluation flowline shutoff valve, a cleanup flowline shutoff valve and combinations thereof.

5. The formation evaluation system of claim 1 wherein the at least one fluid connector is connected to the flowlines at a position downstream of one of an evaluation flowline shutoff valve, a cleanup flowline shutoff valve and combinations thereof.

6. The formation evaluation system of claim 1 further comprising at least one equalization valve extending from one of the at least one evaluation flowline, the at least one cleanup flowline and combinations thereof for fluidly connecting the wellbore thereto.

7. The formation evaluation system of claim 1 wherein the at least one fluid circuit comprises at least one pump, at least one sample chamber and at least one valve for selectively drawing the fluid through the downhole tool.

8. The formation evaluation system of claim 7 wherein at least a portion of the fluid passing into the at least one fluid circuit is dumped to the borehole.

9. The formation evaluation system of claim 7 wherein at least a portion of the fluid passing into the at least one fluid circuit is collected in the at least one sample chamber.

10. The formation evaluation system of claim 7 wherein the fluid circuit comprises a plurality of pumps fluidly connected to the flowlines.

11. The formation evaluation system of claim 7 wherein the at least one pump is adapted to pump fluid in at least one of the flowlines into the borehole.

12. The formation evaluation system of claim 7 wherein the at least one pump is adapted to pump fluid into the at least one sample chamber.

13. The formation evaluation system of claim 7 wherein the at least one pump is adapted to pump a buffer fluid from a chamber of the at least one sample chamber.

14. The formation evaluation system of claim 7 wherein the at least one valve is positioned along a portion of the at least one fluid circuit to selectively permit the flow of fluid through portions thereof.

15. The formation evaluation tool of claim 1 wherein the at least one sensor is adapted to measure properties of the fluid in at least one of the evaluation flowline, the cleanup flowline and combinations thereof.

16. The formation evaluation system of claim 1 further comprising at least one pretest piston operatively connected to one of the at least one evaluation flowline, the at least one cleanup flowline and combinations thereof.

17. The formation evaluation system of claim 1 further comprising at least one isolation valve for selectively permitting the flow of fluid through one of the at least one evaluation flowline, the at least one cleanup flowline and combinations thereof.

18. The formation evaluation system of claim 1 wherein the system is positioned in a module operatively connectable to the downhole tool.

19. A formation evaluation tool positionable in a wellbore penetrating a subterranean formation, the formation having a virgin fluid and a contaminated fluid therein, comprising:

a fluid communication device extendable from the housing for sealing engagement with a wall of the wellbore, the fluid communication device having at least two inlets for receiving the fluids from the formation;

at least one evaluation flowline positioned in the housing and fluidly connected to at least one of the at least two inlets for passage of the virgin fluid into the downhole tool;

at least one cleanup flowline fluidly connected to at least one of the at least two inlets for passage of the contaminated fluid into the downhole tool;

at least one fluid circuit fluidly connected to one of the at least one evaluation flowline, the at least one cleanup flowline and combinations thereof for selectively drawing fluid therein;

at least one fluid connector for selectively establishing a fluid connection between the at least one evaluation flowline and the at least one cleanup flowline; and at least one sensor for measuring downhole parameters in one of the at least one evaluation flowline, the at least one cleanup flowline and combinations thereof.

20. The formation evaluation tool of claim 19 wherein the at least one fluid connector is adapted to one of pass fluid from an upstream portion of the at least one evaluation flowline to a downstream portion of the at least one cleanup flowline, pass fluid from an upstream portion of the at least one cleanup flowline to a downstream portion of the at least one sample flowline and combinations thereof.

21. The formation evaluation tool of claim 19 wherein the at least one fluid connector is connected to the flowlines at a position upstream of one of an evaluation flowline shutoff valve, a cleanup flowline shutoff valve and combinations thereof.

22. The formation evaluation tool of claim 21 wherein the at least one fluid connector is connected to the flowlines at a position downstream of one of an evaluation flowline shutoff valve, a cleanup flowline shutoff valve and combinations thereof.

23. The formation evaluation tool of claim 19 wherein the at least one fluid connector is connected to the flowlines at a position downstream of one of an evaluation flowline shutoff valve, a cleanup flowline shutoff valve and combinations thereof.

24. The formation evaluation tool of claim 19 further comprising at least one equalization valve extending from one of the at least one evaluation flowline, the at least one cleanup flowline and combinations thereof for fluidly connecting the wellbore thereto.

25. The formation evaluation tool of claim 19 wherein the at least one fluid circuit comprises at least one pump, at least one sample chamber and at least one valve for selectively drawing the fluid through the downhole tool.

26. The formation evaluation tool of claim 25 wherein at least a portion of the fluid passing into the at least one fluid circuit is dumped to the borehole.

27. The formation evaluation tool of claim 25 wherein at least a portion of the fluid passing into the at least one fluid circuit is collected in the at least one sample chamber.

28. The formation evaluation tool of claim 25 wherein the fluid circuit comprises a plurality of pumps fluidly connected to the flowlines.

29. The formation evaluation tool of claim 25 wherein the at least one pump is adapted to pump fluid in at least one of the flowlines into the borehole.

30. The formation evaluation tool of claim 25 wherein the at least one pump is adapted to pump fluid into the at least one sample chamber.

31. The formation evaluation tool of claim 25 wherein the at least one pump is adapted to pump a buffer fluid from a chamber of the at least one sample chamber.

32. The formation evaluation tool of claim 25 wherein the at least one valve is positioned along a portion of the at least one fluid circuit to selectively permit the flow of fluid through portions thereof.

33. The formation evaluation tool of claim 19 wherein the at least one sensor is adapted to measure properties of the fluid in at least one of the evaluation flowline, the cleanup flowline and combinations thereof.

34. The formation evaluation tool of claim 19 further comprising at least one pretest piston operatively connected to one of the at least one evaluation flowline, the at least one cleanup flowline and combinations thereof.

35. The formation evaluation tool of claim 19 further comprising at least one isolation valve for selectively permitting the flow of fluid through one of the at least one evaluation flowline, the at least one cleanup flowline and combinations thereof.

36. The formation evaluation tool of claim 19 wherein at least a portion of the downhole tool is modular.

37. The formation evaluation tool of claim 19 wherein the downhole tool is one of wireline, coiled tubing, drilling and combinations thereof.

38. The formation evaluation tool of claim 19 wherein the fluid communication device is one of a probe, dual packers and combinations thereof.

39. A method of evaluating a subterranean formation, the formation having a virgin fluid and a contaminated fluid therein, comprising:

positioning a downhole tool in a wellbore penetrating the formation, the downhole tool having at least two inlets, the at least two inlets adapted to draw the fluids into at least one evaluation flowline and at least one cleanup flowline in the downhole tool;

selectively drawing the fluids into one of the at least one evaluation flowline, the at least one cleanup flowline and combinations thereof;

selectively establishing a fluid connection between the at least one evaluation flowline and the at least one cleanup flowline; and measuring downhole parameters of the fluids in one of the at least one evaluation flowline, the at least one cleanup flowline and combinations thereof.

40. The method of claim 39 further comprising passing the fluids through a fluid circuit.

41. The method of claim 40 wherein the fluid is pumped into the fluid circuit by at least one pump.

42. The method of claim 40 wherein at least a portion of the fluids is diverted into at least one sample chamber.

43. The method of claim 40 wherein at least a portion of the fluids is diverted into the borehole.

44. The method of claim 40 wherein the step of selectively establishing a fluid connection comprises one of passing a fluid from an upstream portion of the at least one evaluation flowline to a downstream portion of the at least one cleanup flowline, passing fluid from an upstream portion of the at least one cleanup flowline to a downstream portion of the at least one evaluation flowline and combinations thereof.

45. The method of claim 40 wherein the step of selectively establishing a fluid connector comprises connecting the flowlines at a position upstream of one of an evaluation flowline shutoff valve, a cleanup flowline shutoff valve and combinations thereof.

46. The method of claim 45 wherein the step of measuring comprises measuring one of pressure, permeability, mobility and combinations thereof of the formation.

47. The method of claim 40 wherein the step of selectively establishing a fluid connector comprises connecting the flowlines at a position downstream of one of an evaluation flowline shutoff valve, a cleanup flowline shutoff valve and combinations thereof.

48. The method of claim 47 wherein the downhole tool further comprises a plurality of fluid circuits connected to at least one of the flowlines downstream of the fluid connector, and wherein fluid is passed between the plurality of fluid circuits.

49. The method of claim 40 further comprising selectively establishing fluid communication between the wellbore and one of the at least one evaluation flowline, the at least one cleanup flowline and combinations thereof.

50. The method of claim 40 further comprising analyzing the measured downhole parameters.

51. The method of claim 50 wherein the downhole parameters of the flowlines are compared.

52. The method of claim 50 wherein the measured downhole parameter is a differential pressure between the at least one evaluation and at least one cleanup flowline.

53. The method of claim 47 wherein the downhole tool further comprises a plurality of fluid circuits connected to at least one of the flowlines, each fluid circuit having at least one pump, and wherein the step of drawing comprises selectively pumping the fluids into one of the at least one evaluation flowline, the at least one cleanup flowline and combinations thereof.

54. The method of claim 53, wherein the pumps are selectively activated to prevent the flow of contaminated fluid into the evaluation flowline.

55. The method of claim 54 further comprising pumping fluid from the evaluation flowline into at least one sample chamber.

56. A method of drawing fluid into a downhole tool, the downhole tool positionable in a wellbore penetrating a formation having a virgin fluid and a contaminated fluid therein, comprising:

positioning a fluid communication device of the downhole tool in sealing engagement with a wall of the wellbore;

establishing fluid communication between at least one evaluation flowline of the fluid communication device and the formation;

establishing fluid communication between at least one cleanup flowline of the fluid communication device and the formation;

pumping fluid into the at least one cleanup flowline at a cleanup pump rate;

pumping fluid into the at least one evaluation flowline at an evaluation pump rate;

selectively altering one of the cleanup pump rate, the evaluation pump rate and combinations thereof for a discrete time interval; and performing formation evaluation of the fluid in one of the evaluation flowline, the cleanup flowline and combinations thereof after the time interval.

57. The method of claim 56 further comprising drawing fluid from the evaluation flowline into a sample chamber.

58. The method of claim 57 wherein fluid is drawn into the sample chamber when the evaluation pump rate is less than the cleanup pump rate.

59. The method of claim 56 wherein the step of selectively altering comprises:

reducing the evaluation pump rate relative to the cleanup pump rate;

reducing the cleanup flow rate to the evaluation pump rate; and increasing the cleanup flow rate.

60. The method of claim 59 further comprising d) increasing the evaluation pump rate.

61. The method of claim 60 further comprising drawing fluid from the evaluation flowline into a sample chamber during step d).

62. The method of claim 61 further comprising opening a valve to divert fluid from the evaluation flowline to the sample chamber after step b).

63. The method of claim 62 further comprising closing the valve at one of during step d) and after step d).

64. The method of claim 56 wherein the rates are one of synchronized, unsynchronized and combinations thereof.

* * * * *